United States Patent [19]

Brandyberry et al.

[11] Patent Number: 4,495,759

[45] Date of Patent: Jan. 29, 1985

[54] MANUFACTURE OF METALLIC CABLE

[75] Inventors: Dennis R. Brandyberry, Canton; Grover W. Rye, Cuyahoga Falls, both of Ohio

[73] Assignee: The Goodyear Tire & Rubber Company, Akron, Ohio

[21] Appl. No.: 539,191

[22] Filed: Oct. 5, 1983

[51] Int. Cl.[3] ..... D07B 3/12

[52] U.S. Cl. ..... 57/58.52; 57/58.63; 57/58.83

[58] Field of Search ..... 57/3, 9, 14, 15, 311, 57/58.49–58.63, 58.7, 58.83

[56] References Cited

U.S. PATENT DOCUMENTS

| | | | |
|---|---|---|---|
| 3,309,857 | 3/1967 | Haugwitz | 57/58.52 X |
| 3,774,385 | 11/1973 | Maderna | 57/58.52 |
| 3,791,131 | 2/1974 | Scott et al. | 57/58.52 X |
| 3,847,190 | 11/1974 | Forester | 57/14 X |
| 3,867,809 | 2/1975 | Holbrook | 57/58.63 X |
| 4,335,571 | 6/1982 | Tarantola | 57/311 X |
| 4,437,297 | 3/1984 | Vespasiani | 57/58.55 X |

FOREIGN PATENT DOCUMENTS

| | | |
|---|---|---|
| 3014190 | 10/1980 | Fed. Rep. of Germany . |
| 2098251 | 11/1982 | United Kingdom . |

*Primary Examiner*—John Petrakes

*Attorney, Agent, or Firm*—L. R. Drayer

[57] ABSTRACT

A metallic cable comprises a strand comprising a plurality of parallel filaments twisted with another strand comprising at least one filament. The cable is manufactured using a two for one twist principle.

3 Claims, 2 Drawing Figures

MANUFACTURE OF METALLIC CABLE

BACKGROUND OF THE INVENTION

The present invention relates to a method of manufacturing metallic cable, and more specifically to a method of manufacturing a metallic cable comprising a strand of untwisted filaments and another strand of twisted filaments with the two strands twisted together.

One of the most efficient methods of manufacturing metallic cables of the type used for reinforcing elastomeric articles, such as tires or belts, is to employ the two for one twist principle. As used herein, the "two for one twist principle" refers to two twists being imparted to a strand or cable for each rotation of the flyers of a cable making machine. While the two for one twist principle is already known in the cable marking art, it has not been considered feasible heretofore to manufacture cables having a strand of parallel filaments using this principle. Consequently, the production of a cable construction of this type, for example a cable comprised of one strand of two parallel filaments twisted with a strand of two filaments that are twisted with one another, has resulted in a fifty percent reduction of the efficiency of a cable making machine. There is disclosed herein a method of manufacturing this same type of metallic cable employing a two for one twist principle without a reduction in the efficiency of a cable making machine.

BRIEF DESCRIPTION OF THE DRAWING

The invention will be better understood by referring to the figures of the drawing, wherein.

DETAILED DESCRIPTION OF THE INVENTION

Figure 1:
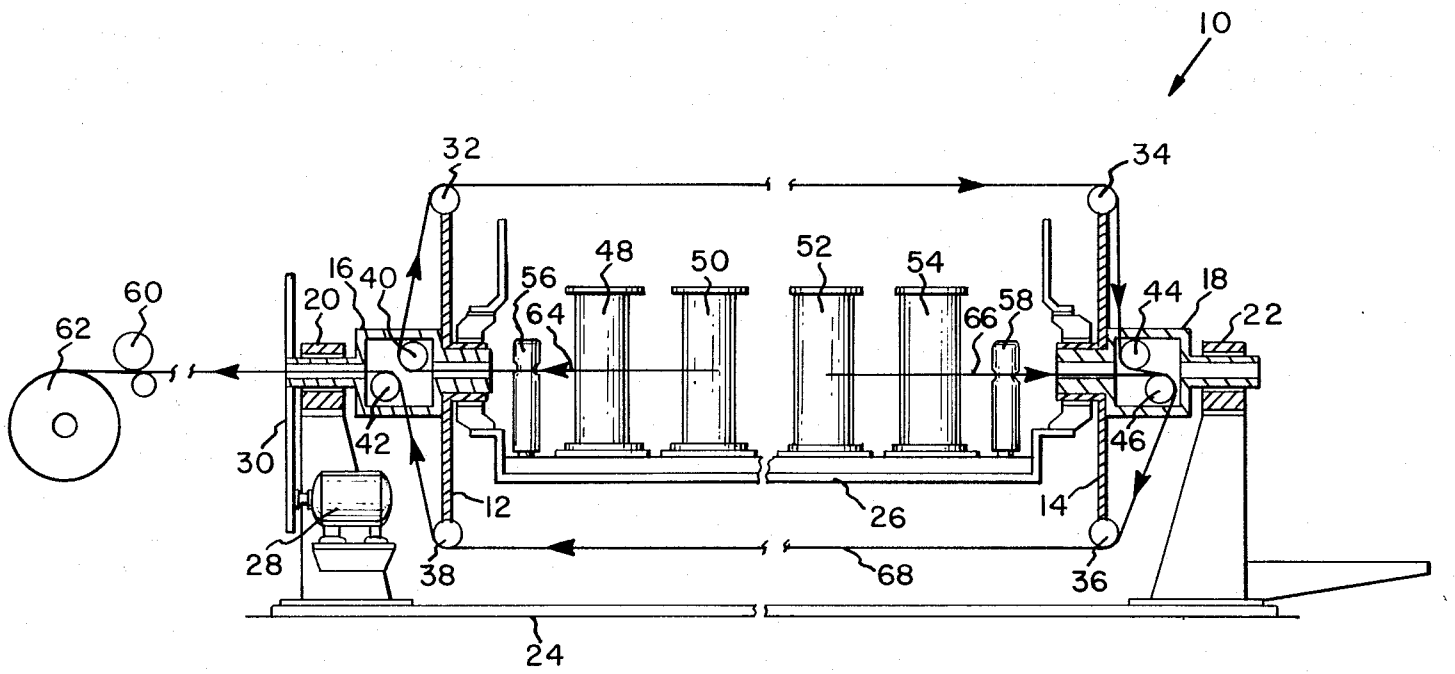
FIG. 1 is a schematic side elevational view of a cable making machine with the paths of the various components of a cable indicated thereon.
Figure 2:
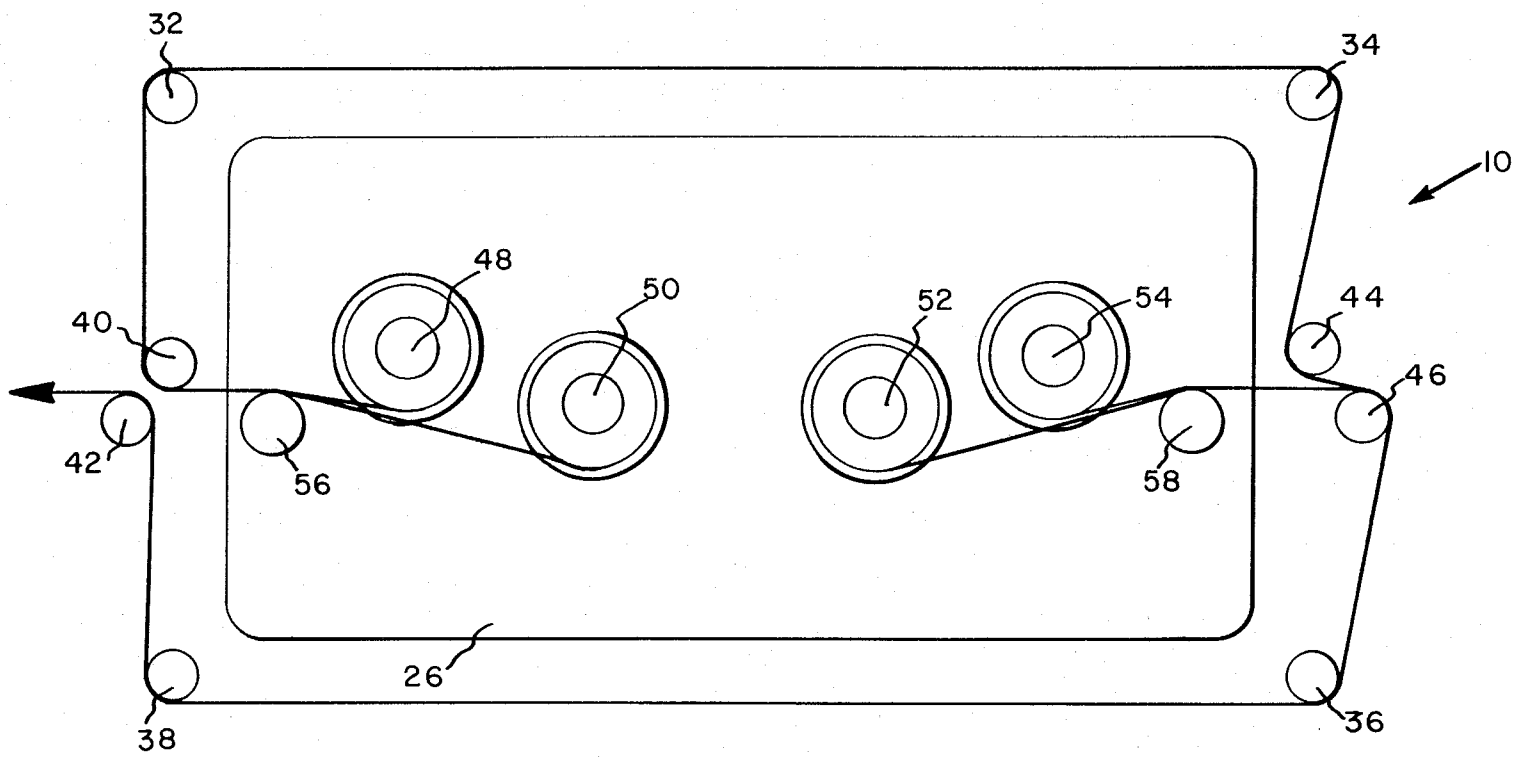
FIG. 2 is a top schematic view of the cable making machine of FIG. 1 with the flyers rotated 90° from their position in FIG. 1.

There is illustrated in FIGS. 1 and 2 side and top schematic views, respectively, of a cable making machine 10 of the type that may be used to practice the present invention. A cable making machine comprises first 12 and second 14 coaxial and interconnected rotating flyers. The rotating flyers have hollow bearings 16,18 that are rotatably attached to a means for support 20,22 that rest upon a base 24. A non-rotating cradle 26 is swingably attached to the hollow bearings 16,18 of the first and second flyers. A means for rotating, such as an electric motor 28 connected to the bearing of one of the flyers by a combination of pulleys and a belt 30, causes the flyers to rotate about their mutual axis. A series of flyer pulleys 32,34,36,38 are disposed at, or near, the radially outer edges of the flyers. First 40 and second 42 sunken rotating pulleys are attached to the inside of the hollow bearing 16 of the first rotating flyer, and first 44 and second 46 sunken rotating pulleys are attached to the inside of the hollow bearing 18 of the second rotating flyer. The walls of the hollow bearings have passageways therethrough in the regions of the sunken rotating pulleys to allow filaments, strands or a cable to pass from the interior to the exterior of the hollow bearings.

A plurality of bobbin means 48,50,52,54 are attached to the non-rotating cradle 26. While four bobbin means are illustrated in the drawing, it is understood that the number of bobbin means actually employed is dependent upon the particular cable construction that is to be manufactured. Spools of metallic filaments are placed upon the bobbin means to supply the cable making machine. Although the bobbin means illustrated in the drawings have vertical axes of rotation that are perpendicular to the horizontal axis of rotation of the flyers, the method of manufacturing a cable according to the invention may be practiced with a cable making machine having bobbin means with horizontal axes that are perpendicular to the axis of the flyers. Idler rolls 56,58 are attached to the non-rotating cradle to align the metallic filaments drawn from the bobbin means with the axis of rotation of the flyers.

A means for drawing, such as a capstan 60, draws the metallic filaments from the bobbin means and draws the filaments, strands and resultant cable through, around and past various components of the cable making machine. A means for collecting a finished cable, such as a rotating spool 62, places the finished cable around a storage spool.

As used herein, a "filament" refers to an individual metallic wire; a "strand" refers to one or more filaments that form a unit; and a "cable" refers to a structure comprising two or more strands.

All of the steps involved in the disclosed method of manufacturing a cable will be occuring at the same time for different segments along the length of the cable, but each segment along the length of the cable will have been subjected to each step of the process.

A first strand 64 is formed by drawing a plurality of metallic filaments from a plurality of bobbin means 48,50 attached to the non-rotating cradle 26 of a cable making machine 10 and aligning the plurality of filaments along the axis of rotation of the first and second flyers 12,14 of the cable making machine. The force for drawing filaments, strands and the cable in various steps of the process is supplied by a means for drawing, such as a capstan 60. The first strand is drawn next to and partially around a first sunken rotating pulley 40 attached to the inside of the hollow bearing of the first flyer to impart a first twist to the filaments of the first strand in a first direction.

As used herein, "direction of twist" refers to the direction of slope of the spirals of a strand or filament when a cable is held vertically. If the slope of the spirals conform in direction to the slope of the letter "S", then the twist is called "S" or "left-hand". If the slope of the spirals conforms to the slope of the letter "Z", then the twist is called "Z" or "left hand". In manufacturing a cable according to the process disclosed herein, twisting in "a first direction" may be either in the "S" or "Z" direction, and twisting in "a second direction" means twisting in the opposite direction.

The first strand 64 is drawn past the first and second rotating flyers, passing next to and partially around the respective flyer pulleys 32,34. Next the first strand is drawn next to and partially around a second rotating pulley 44 attached to the inside of the hollow bearing of the second rotating flyer 14, to impart a second twist to said first strand in said first direction. In other words, for every rotation of the flyers two twists are imparted to the first strand in a first direction, according to what is referred to as the two for one twist principle.

A second strand 66 is formed by drawing at least one metallic filament from a bobbin means attached to the non-rotating cradle, and aligning the filament or filaments along the axis of rotation of the flyers. This alignment may be accomplished using an idler roll 58 as a guide.

A cable 68 is formed by drawing the first and second strands next to and partially around a third sunken rotating pulley 46 attached to the inside of the hollow bearing of the second rotating flyer 14 to impart a first twist to the first and second strands in a second direction and partially untwist the filaments of the first strand.

The cable is drawn past the second and first rotating flyers in a direction opposite to the direction that the first strand was drawn past the first and second rotating flyers, passing next to and partially around the respective flyer pulleys 36,38.

The cable is drawn next to and partially around a fourth sunken rotating pulley 42 attached to the inside of the hollow bearing of the first rotating flyer to impart a second twist to the strands in said second direction and completely untwist the filaments of the first strand.

The finished cable may then be wound onto a means for collecting a finished cable 62.

It will be apparent to one skilled in the cable making art that after twisting the filaments of the first strand two times in a first direction and then two times in a second direction, the filaments of the first strand will be parallel to one another. Furthermore, by only twisting the second strand two times in the second direction if the second strand comprises more than one filament those filaments will be twisted together in the second direction and the first and second strands will be twisted together in the second direction.

While certain representative embodiments and details have been shown for the purpose of illustrating the invention, it will be apparent to those skilled in the art that various changes and modifications may be made therein without departing from the spirit or scope of the invention.

What is claimed is:

1. A method of manufacturing a metallic cable comprising the steps of:

(a) forming a first strand by drawing a plurality of metallic filaments from a plurality of bobbin means attached to a non-rotating cradle of a cable making machine and aligning said plurality of filaments along the axis of rotation of first and second coaxial rotating flyers of said cable making machine;

(b) drawing said first strand next to and partially around a first sunken rotating pulley attached to the inside of a hollow bearing of said first rotating flyer to impart a first twist to the filaments of said first strand in a first direction;

(c) drawing said first strand past said first and second rotating flyers;

(d) drawing said first strand next to and partially around a second rotating pulley attached to the inside of a hollow bearing of said second rotating flyer to impart a second twist to said first strand in said first direction;

(e) forming a second strand by drawing at least one metallic filament from a bobbin means attached to said non-rotating cradle and aligning said at least one filament along the axis of rotation of said first and second flyers;

(f) forming a cable by drawing said first and second strands next to and partially around a third sunken rotating pulley attached to the inside of the hollow bearing of said second rotating flyer to impart a first twist to said first and second strands in a second direction and partially untwist the filaments of said first strand;

(g) drawing said cable past said second and first rotating flyers; and (h) drawing said cable next to and partially around a fourth sunken rotating pulley attached to the inside of the hollow bearing of said first rotating flyer to impart a second twist to said strands in said second direction and completely untwist the filaments of said first strand.

2. A method of manufacturing a metallic cable according to claim 1 further comprising the step (i) of winding said cable onto a means for collecting a finished cable.

3. A method of manufacturing a metallic cable according to claim 2 wherein said filaments, strands and cable are drawn by a capstan.

* * * * *